US005857765A

United States Patent [19]

Deron

[11] Patent Number: 5,857,765

[45] Date of Patent: Jan. 12, 1999

[54] LIGHTING FIXTURE

[75] Inventor: Ivo O. Deron, Inman, S.C.

[73] Assignee: Progress Lighting, Spartanburg, S.C.

[21] Appl. No.: 754,864

[22] Filed: Nov. 22, 1996

[51] Int. Cl.[6] ..... F21V 5/04

[52] U.S. Cl. ..... 362/249; 362/252; 362/367; 362/405

[58] Field of Search ..... D26/35, 36, 125, D26/126, 72, 80–92; 362/367, 404, 405, 406, 249, 252

[56] References Cited

U.S. PATENT DOCUMENTS 4,127,892 11/1978 Bakalowits et al. ..... 362/405
4,528,620 7/1985 Weber ..... 362/405

OTHER PUBLICATIONS

Thomas, Beautiful American Lighting by Design catalog, p. 62, 1983.

Manning Contemporary, p. A5, Aug. 1975.

*Primary Examiner*—Thomas M. Sember
*Attorney, Agent, or Firm*—Dority & Manning, P.A.

[57] ABSTRACT

A lighting fixture includes a vertical center column, at least one light element operatively attached to the center column, and a plurality of vertical panes. An attachment mechanism is configured to attach the panes to the center column so that the panes, when attached to the center column, extend radially outward from the center column and so that the panes are releasably detachable from the center column outside the center column.

36 Claims, 8 Drawing Sheets

LIGHTING FIXTURE

BACKGROUND OF THE INVENTION

The present invention relates to lighting fixtures, particularly of the type suspended from a cable or chain and used, for example, for hallways and foyers. More particularly, the invention relates to improvements in mounting panes of such lighting fixtures.

Light fixtures, for example such as are frequently suspended in halls and foyers, often include planar shaped panes. Typically, these panes circumferentially surround the center column of the fixture, creating a substantially enclosed structure. The fixtures generally include arms or other structures extending from the center column to secure the panes in their circumferential positions. The fixtures tend to be bulky and are typically shipped in their finally constructed form. Thus, they must be shipped in relatively large containers, resulting in relatively large shipping costs compared to the amount and weight of materials included in the fixture.

Additionally, the interior surfaces of panes permanently mounted in the fixture are difficult to clean. While fixtures have been constructed so that the circumferential panes hook onto support arms extending from the center column, thus permitting their removal for cleaning, the structure of the fixture still requires relatively large shipping containers. Similarly, while fixtures have been constructed having permanently attached panes extending radially from the center column, such fixtures generally require relatively large shipping containers.

SUMMARY OF THE INVENTION

The present invention recognizes and addresses the foregoing disadvantages, and others, of prior art construction and methods.

Accordingly, it is an object of the present invention to provide an improved lighting fixture.

More particularly, it is an object of the present invention to provide an improved lighting fixture having removable panes.

It is a still further object of the present invention to provide an improved lighting fixture having removable panes which may be attached to a center column so that the panes extend radially from the center column.

Some of these objects are achieved by a lighting fixture including a vertical center column, at least one light element operatively attached to the center column, and a plurality of vertical panes. The lighting fixture also includes an attachment mechanism configured to removably attach the panes to the center column so that the panes, when attached to the center column, extend radially outward from the center column.

In a preferred embodiment, the lighting fixture includes a bottom cap attached to the center column proximate the lower vertical end thereof. Each pane rests on the bottom cap so that the panes are vertically supported. The bottom cap may have structures to additionally retain the panes. For example, the bottom cap may include radial grooves, notches or brackets to prevent the panes from rotational movement with respect to the center column. Furthermore, holes may be provided in the bottom cap to receive a downward vertical pin extending from each pane to prevent the bottom of each pane from undesirably sliding out from the fixture. Alternatively, the bottom cap may include upward vertical pins to be received by a hole in the pane.

The fixture may also include an upper attachment mechanism to maintain a horizontal position of the panes. For example, longitudinal grooves may be provided in the center column to receive the panes. An upper cap may be attached to the center column to receive an upward vertical pin extending from each pane. Brackets may extend radially from the center column to receive each pane.

The panes are removably attached to the center column through, for example, one or more of the mechanisms described above. For example, each pane may be placed into position so that it rests against the center column and the bottom cap to be finally secured to the center column by placement of the top cap over upwardly extending pins from the panes. Alternatively, for example where the top and bottom caps are permanently attached to the center column or are attached prior to insertion of the panes, the upward vertical pin may be inserted to the top cap while the pane is pushed to an upwardmost position with respect the upper cap. The bottom section of the pane may then be moved toward the center column until the downward extending pin reaches a hole in the bottom cap. At this time, the pane may be lowered so that the bottom pin is received into the hole of the bottom cap, the upward extending pin being long enough to maintain its position in the upper cap. Those of ordinary skill in this art should understand that various other suitable configurations for removably attaching the panes to the center column may be employed.

The accompanying drawings, which are incorporated in and constitute a part of this specification, illustrate various embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
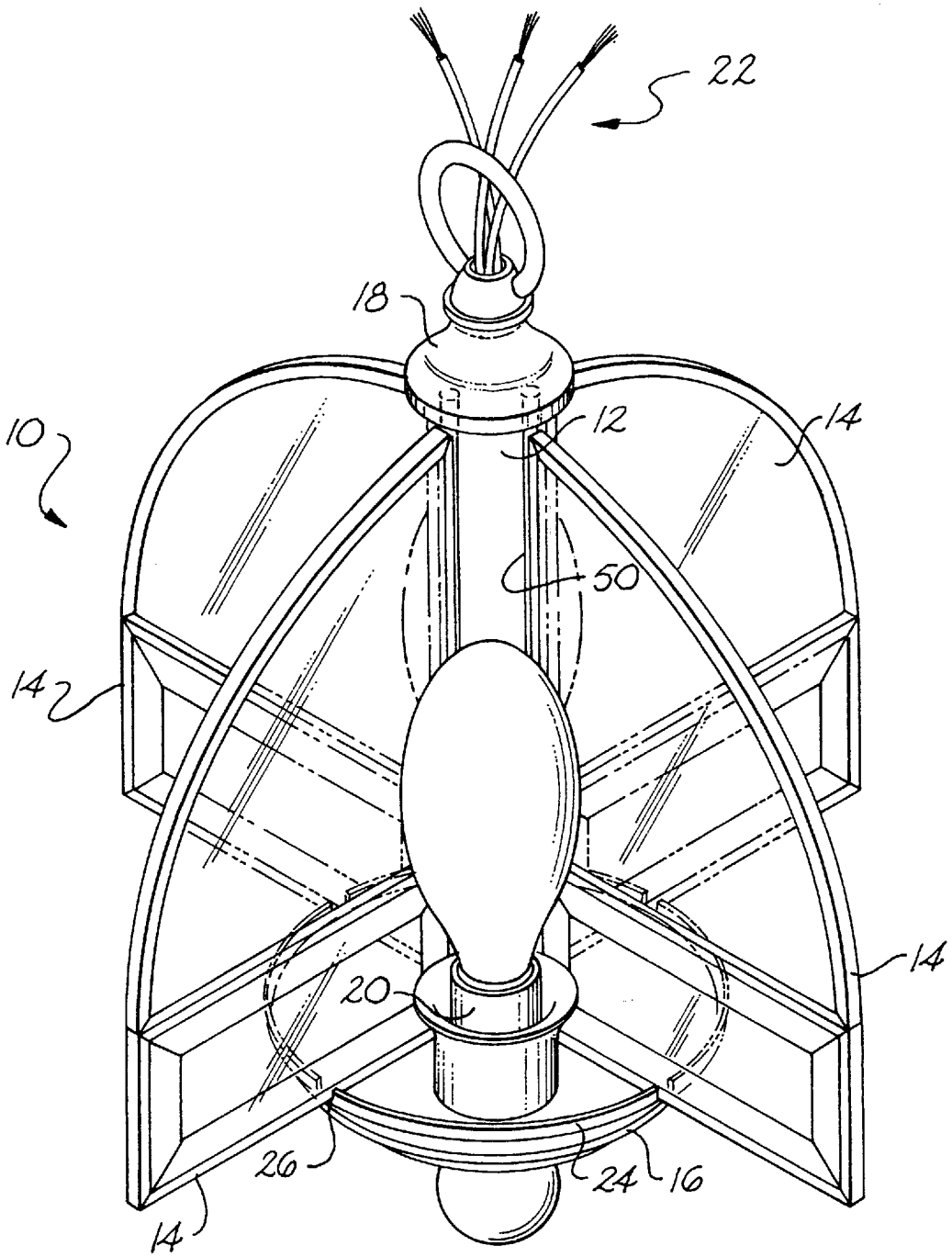
FIG. 1 is a perspective view of a lighting fixture constructed in accordance with the present invention.

Repeat use of reference characters in the present specification and drawings is intended to represent same and analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

The present invention is concerned with an improved lighting fixture. Accordingly, FIG. 1 illustrates a lighting fixture 10 including a center column 12 having a plurality of vertical panes 14 attached thereto by a bottom cap 16 and an upper cap 18.

Light elements 20 are operatively attached to center column 12 on bottom cap 16. Energy is provided to the lights by wiring 22 extending through the interior of center column 12. Two lights 20 are illustrated in FIG. 1. It should be understood, however, that various configurations of lights may be employed. For example one or more lights may be disposed between each pair of adjacent panes 14.

Bottom cap 16 includes a circumferential rim 24 including notches 26 for receiving bottom edges of panes 14. Notches 26 tend to prevent rotational movement of panes 14 with respect center column 12. In a preferred embodiment illustrated in FIG. 2B, bottom cap 16 includes grooves 28 for receiving bottom edges of panes 14. In a preferred embodiment illustrated in FIG. 2C, brackets 30 are provided for the same purpose. It should be understood that other suitable bottom cap constructions may be employed.

Figure 2A:
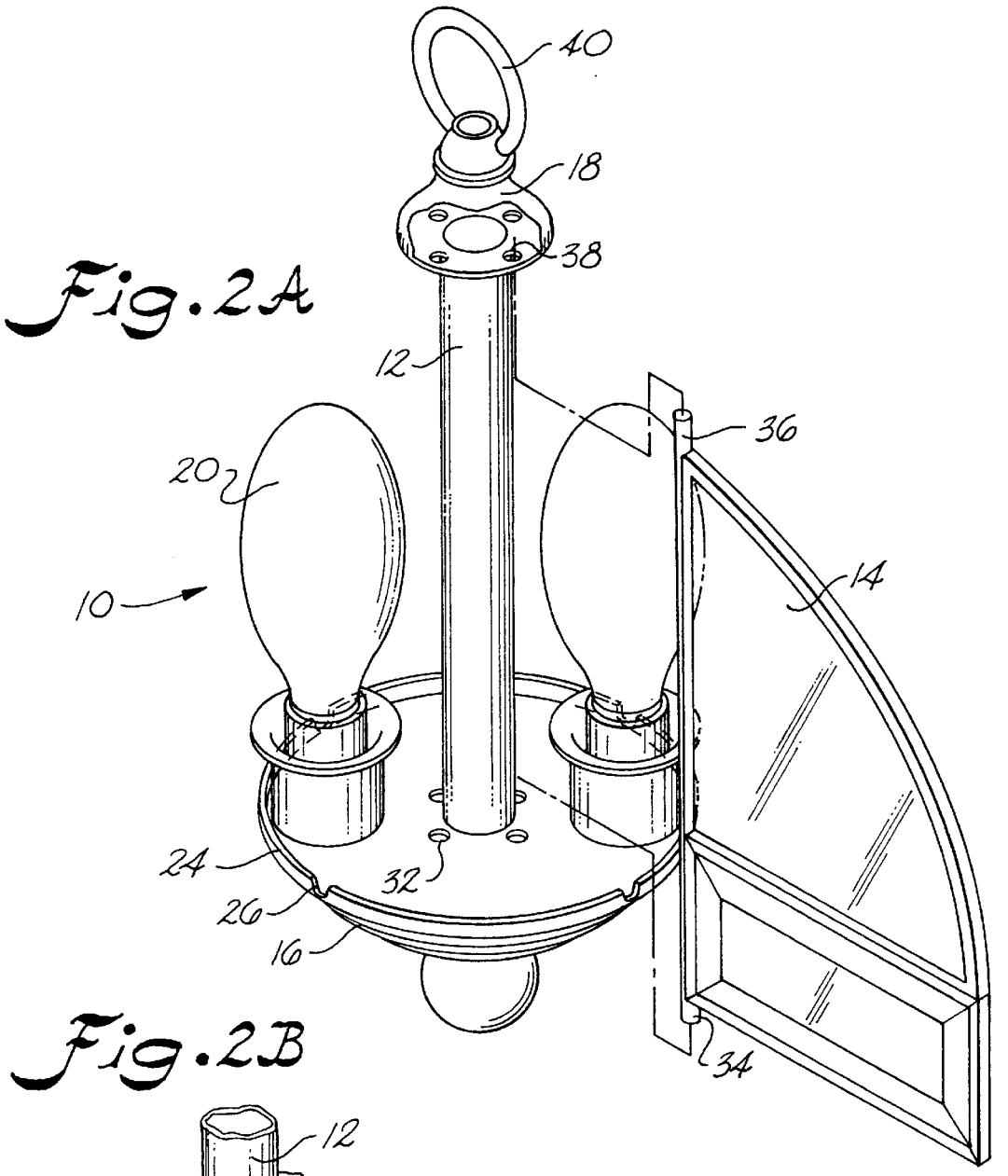
FIG. 2A is a partial perspective and exploded view of a lighting fixture constructed in accordance with the present invention.
Figure 2B:
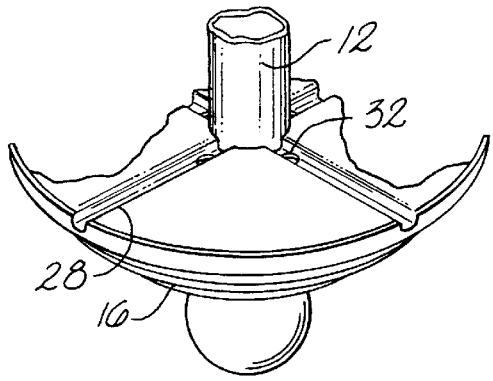
FIG. 2B is a partial perspective and cut-away view of a lighting fixture constructed in accordance with the present invention.
Figure 2C:
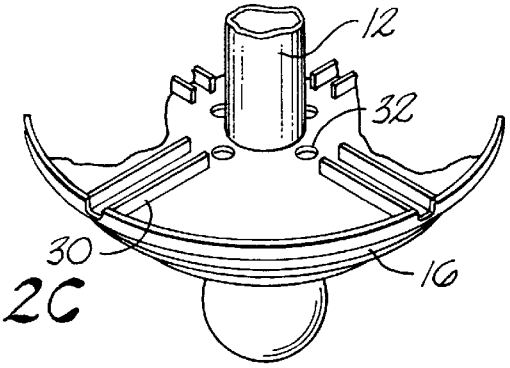
FIG. 2C is a partial perspective and cut-away view of a lighting fixture constructed in accordance with the present invention.

Accordingly, as illustrated in the figures, bottom cap 16 vertically supports each pane, thereby vertically securing the pane to the center column. The bottom cap may also horizontally secure the pane to the center column, for example by notches 26, grooves 28 and brackets 30 as shown in FIGS. 2A, 2B and 2C respectively. Additionally, bottom cap 16 may define holes 32 to receive downward extending pins 34 (FIG. 2A) of panes 14 to prevent undesirable horizontal movement.

Figure 7:
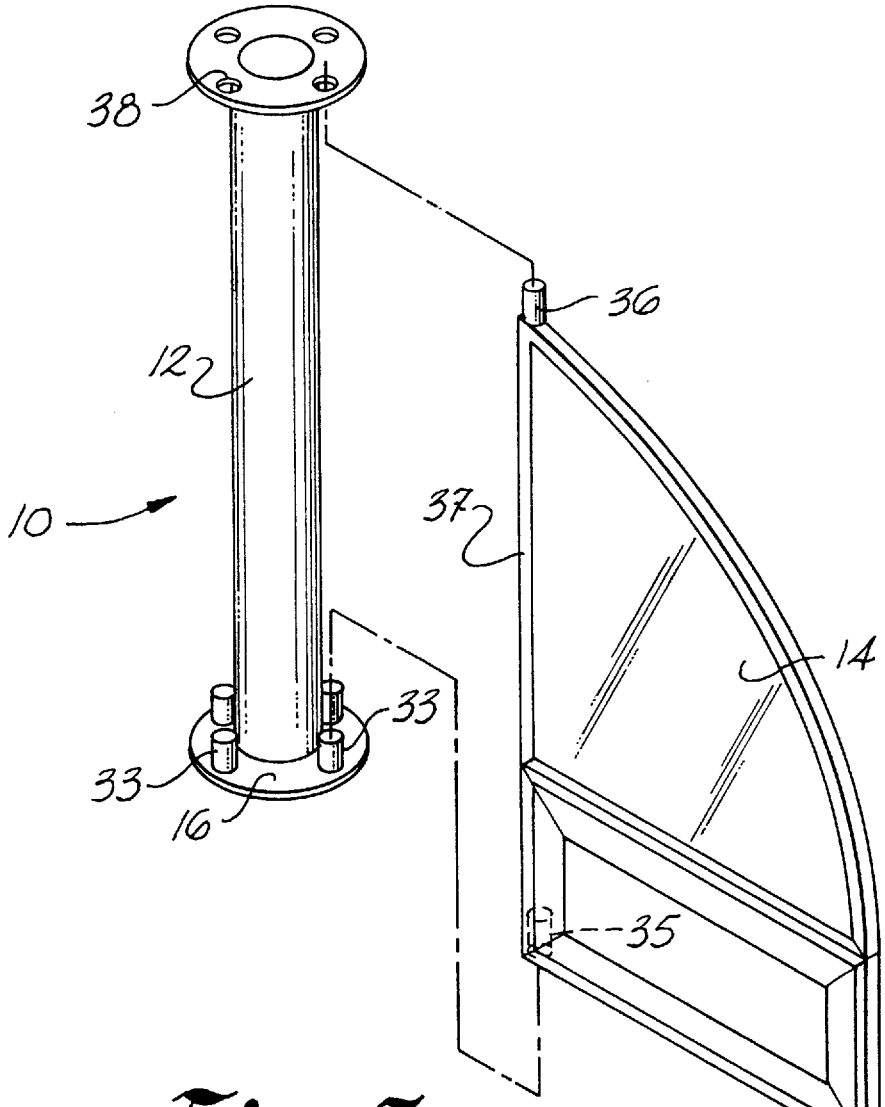
FIG. 7 is a partial perspective and exploded view of a lighting fixture constructed in accordance with the present invention.

As noted, bottom cap 16 may be constructed in various suitable configurations. For example, the cap may be a relatively shallow ring that does not extend substantially beyond the circumference of center column 12. Alternatively, for example, the bottom cap may extend relatively far beyond the center column circumference, as illustrated in the figures, to form a shelf upon which the panes rest. The bottom cap may include holes to receive pins from the panes, as shown in FIG. 2A, or pins that are received by corresponding holes in the panes. For example, the pane 14 illustrated in FIG. 7 includes a hole 35 to receive a corresponding upward vertical pin 33 on bottom cap 16.

Similarly, upper cap 18 may be constructed in various suitable manners. Furthermore, while the upper and bottom caps are preferably separate pieces attached to the center column, it should be understood that each may be integrally constructed with the center column.

Referring again to FIG. 2A, each pane 14 may also include an upper vertical pin 36 for receipt in holes 38 of upper cap 18. Upper cap 18 may include a ring 40 for attachment to a chain or cable so that fixture 10 may be suspended from a ceiling or other support.

As illustrated in FIG. 2A, pane 14 may be removably attached to center column 12 by bottom cap 16 and upper cap 18. In the illustrated configuration, upper pin 36 may be inserted in a hole 38 while the lower portion of pane 14 is brought in toward center column 12 and down to bottom cap 16 to bring lower pin 34 to the hole 32 opposite the hole 38 receiving upper pin 36. Pane 14 is then set down upon bottom cap 16 such that pin 34 is received by its respective hole 32 and so that the bottom edge of pane 14 is received by the corresponding notch 26. Upper pin 36 is long enough to remain received by its respective hole 38 when pane 14 is secured by the bottom cap. For example, in a preferred embodiment, pin 36 is a ¾ inch pin while pin 34 is a ¼ inch pin.

Figure 3:
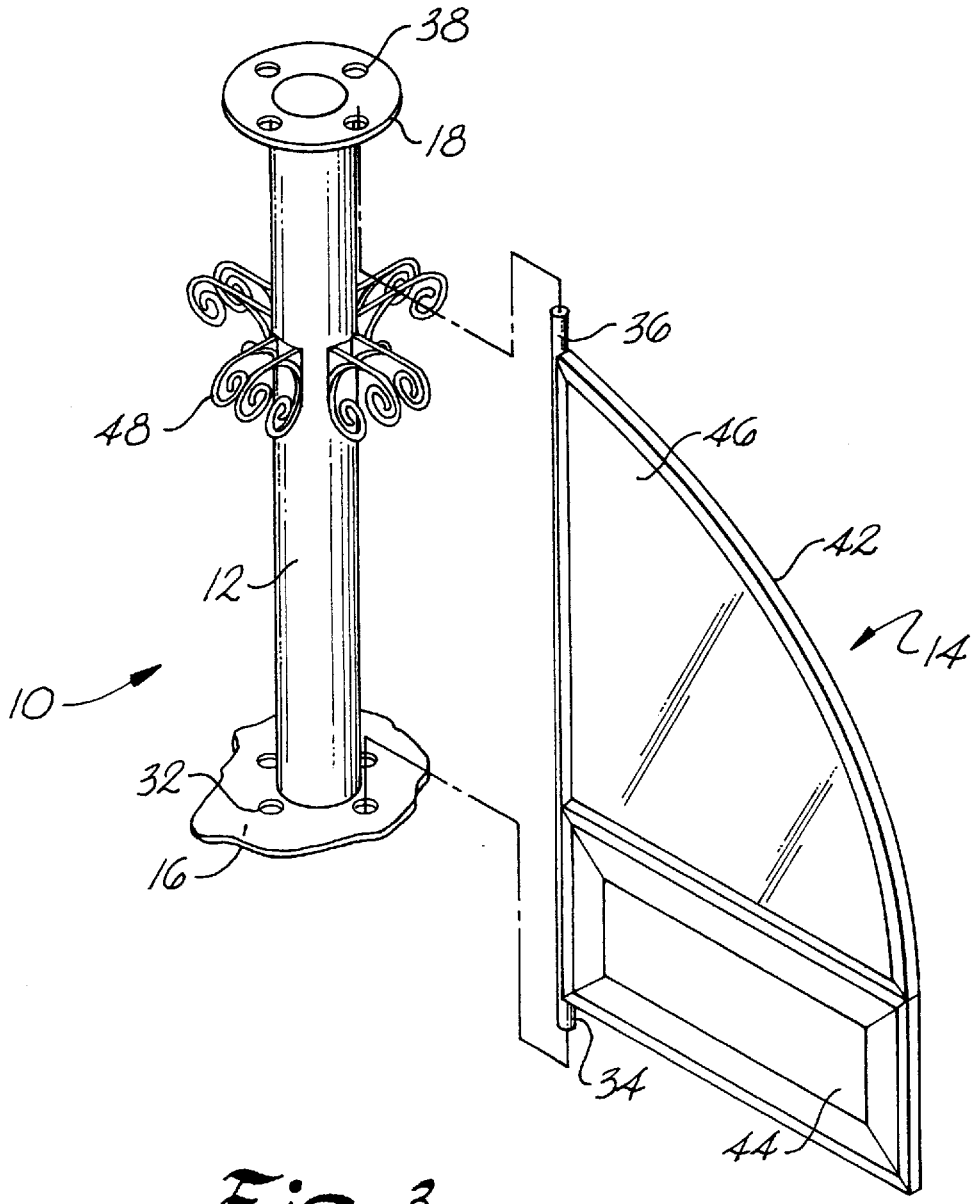
FIG. 3 is a partial perspective and cut-away and exploded view of a lighting fixture constructed in accordance with the present invention.

As illustrated in FIGS. 2A and 3, pane 14 includes an elongated rod extending along the interior side of the pane to form pins 36 and 34. It should be understood, however, that the pins may be constructed in a variety of forms and that panes 14 may employ various suitable constructions. For example, as illustrated in FIG. 3, pane 14 includes a frame 42 bounding pane sections 44 and 46. The pane sections may be constructed from various materials, including glass, plastic or metal. Pins 34 and 36 may be integrally constructed with frame 42 or may be a separate piece or pieces attached thereto. Furthermore, the entire pane 14 may be unitarily constructed and may include pins 34 and 36, or other attachment mechanisms.

Figure 4:
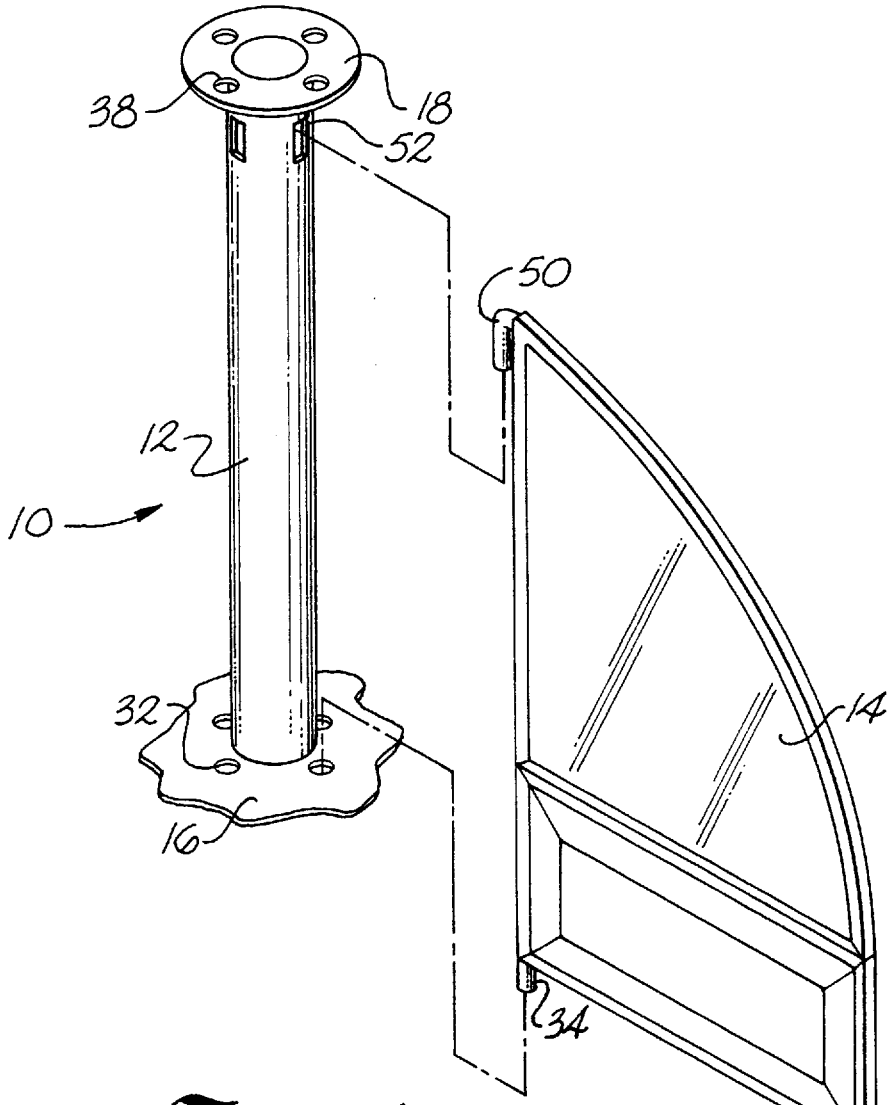
FIG. 4 is a partial perspective and cut-away and exploded view of a lighting fixture constructed in accordance with the present invention.

Various other attachment mechanisms may be employed with the present invention. For example, as illustrated in FIG. 3, brackets 48 may be provided on center column 12 to receive panes 14. Furthermore, as illustrated in FIG. 1, grooves 50 may be provided in center column 12 to receive the interior edge of panes 14. Referring to FIG. 4, a hooked-shaped side pin 50 may be provided on pane 14 and received in a slot 52 of center column 12. Although not necessary in this configuration, holes 38 may be provided in cap 18 to permit interchangability of differently constructed panes.

Figure 6:
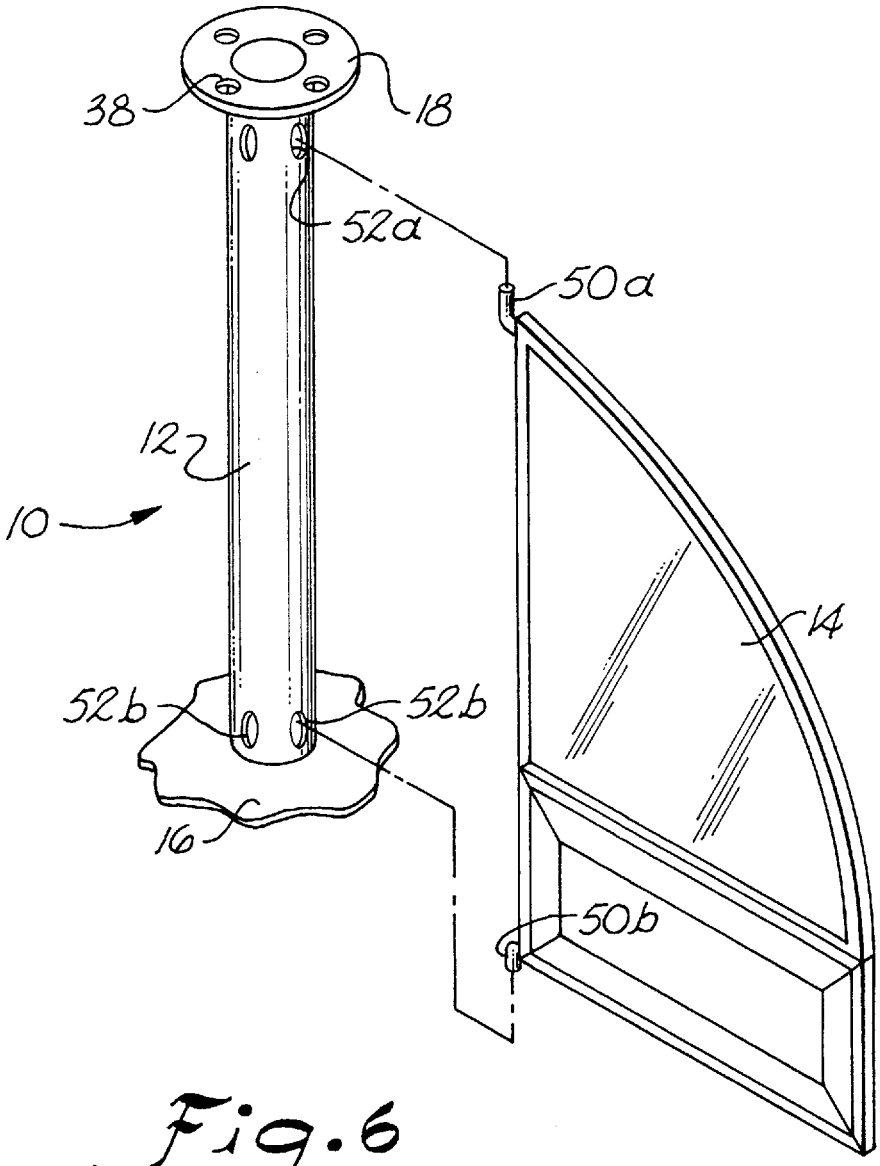
FIG. 6 is a partial perspective and cut-away and exploded view of a lighting fixture constructed in accordance with the present invention.

In other preferred embodiments, vertical support of the panes is provided by the center column 12 alone. For example, as illustrated in FIG. 6, side pins 50*a* and 50*b* may be received in oblong slots 52*a* and 52*b* of center column 12 so that the side pins support the weight of the pane. The pins and the slots are configured so that the pane may be pushed upwards after insertion of pin 50*a* to allow insertion of pin 50*b* in slot 52*b*. Pin 50*a* is long enough so that, when the pane is released to its sitting position, pin 50*a* will remain hooked in slot 52*a*. On the other hand, pin 50*b* is short enough so that it can be inserted into slot 52*b* when pin 50*a* is already inserted in slot 50*a*.

Lateral support may be provided to a pane 14 attached to center column 12 in a configuration such as shown in FIG. 6 by mechanisms included on bottom cap 16, such as notches 26 (FIG. 2A), grooves 28 (FIG. 2B) or brackets 30 (FIG. 2C). Alternatively, or additionally, lateral support may be provided by brackets such as brackets 48 (FIG. 3) attached to the center column. In the latter type of construction, or other constructions where the pane is supported by the center column, bottom cap 16 may be omitted.

Figure 5:
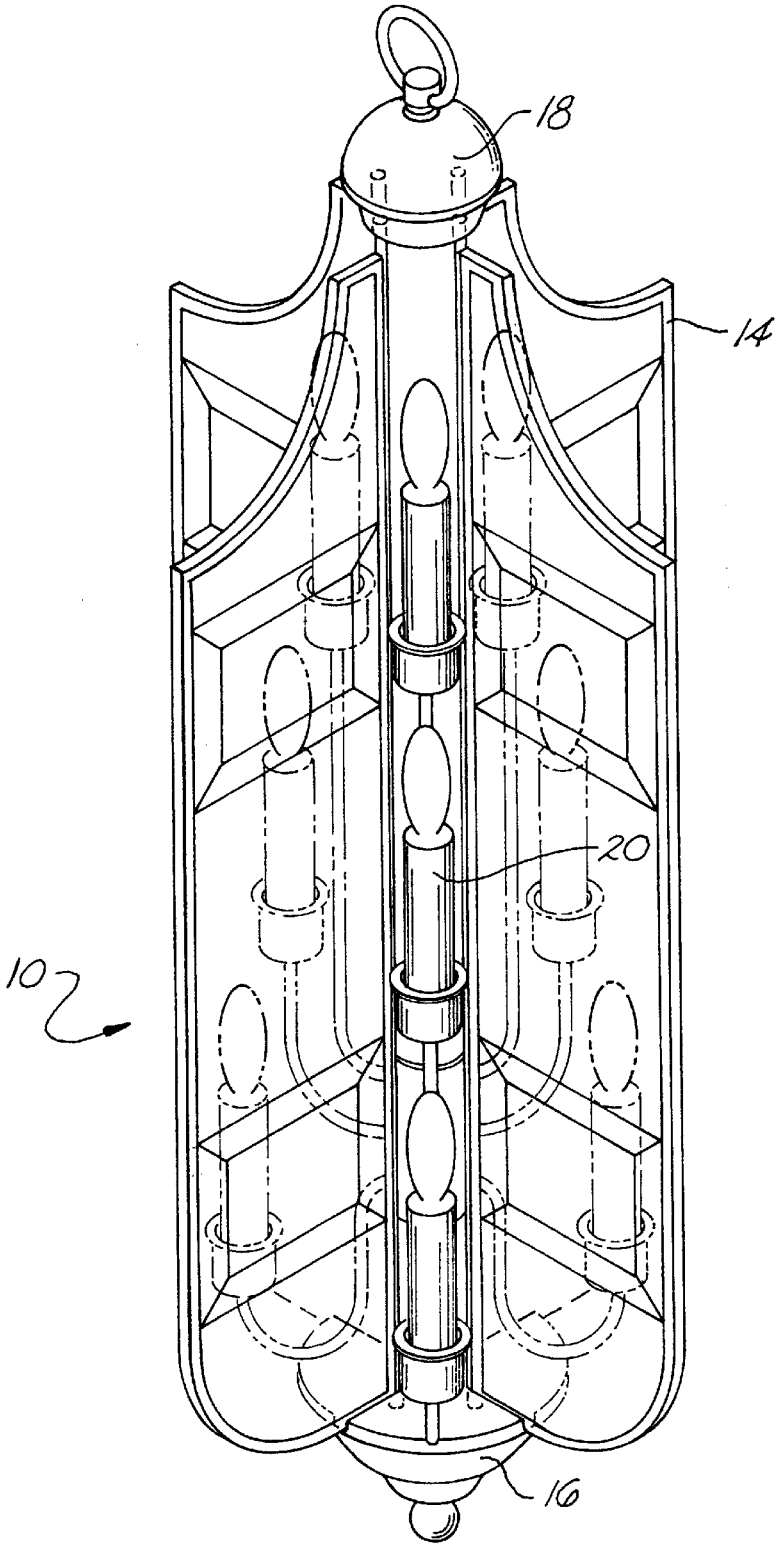
FIG. 5 is a perspective view of a lighting fixture constructed in accordance with the present invention.
Figure 8:
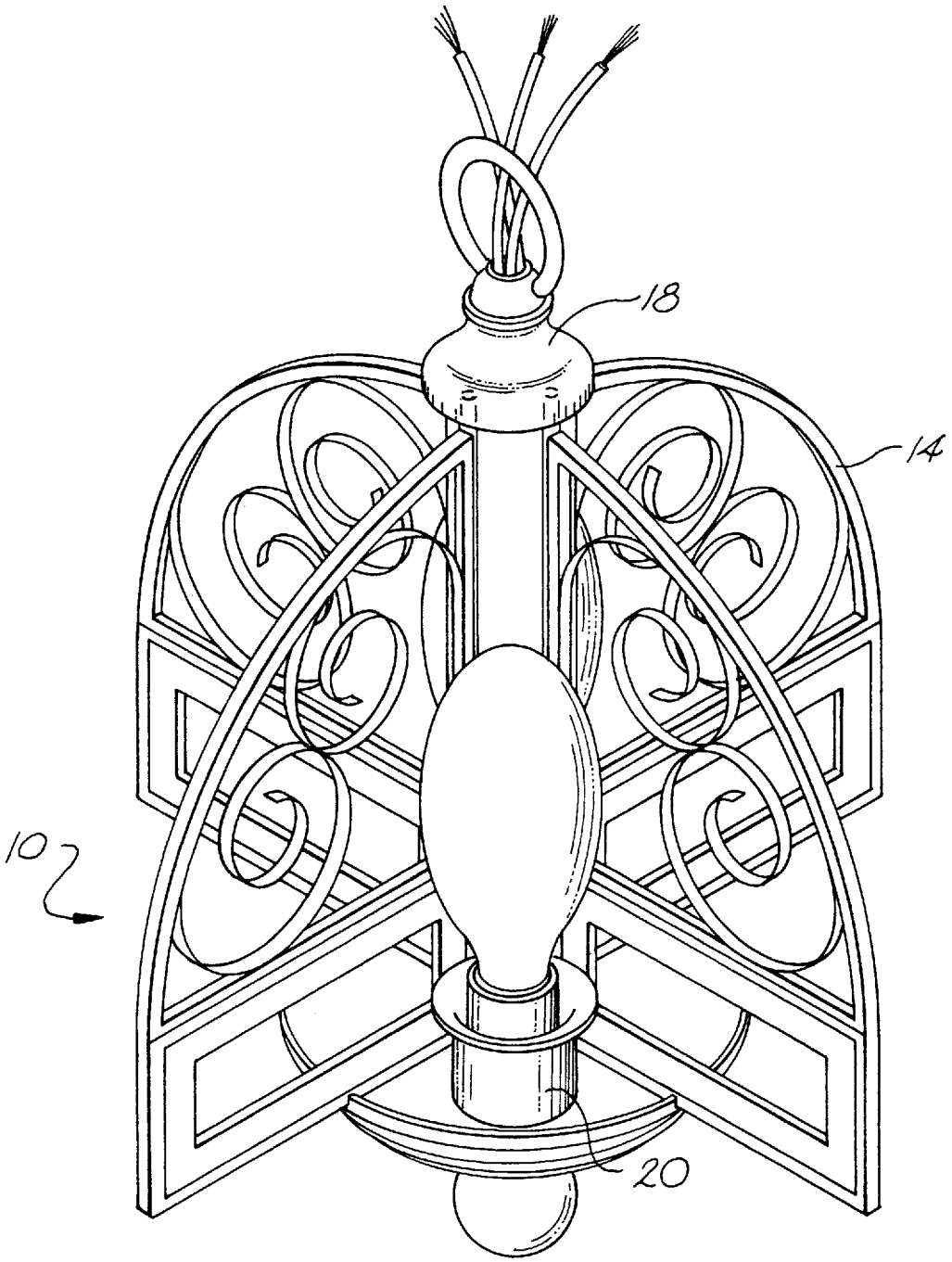
FIG. 8 is a perspective view of a lighting fixture constructed in accordance with the present invention.

Panes 14 may be constructed in various shapes, for example for decorative reasons. FIG. 5 illustrates exemplary panes 14 having multiple lights 20 disposed between each pair of adjacent panes. FIG. 8 illustrates panes 14 having an open wrought iron pattern without intervening glass or plastic.

While preferred embodiments of the invention have been described above, it is to be understood that any and all equivalent realizations of the present invention are included within the scope and spirit thereof Thus, the embodiments depicted are presented by way of example only and are not intended as limitations upon the present invention, and those of ordinary skill in this art should understand that many modifications may be made. Therefore, it is contemplated that any and all such embodiments are included in the present invention as may fall within the literal or equivalent scope of the appended claims.

What is claimed is:

1. A lighting fixture, said lighting fixture comprising:

a vertical center column;

at least one light element operatively attached to said center column;

a plurality of vertical panes; and an attachment mechanism configured to attach said panes to said center column so that said panes, when attached to said center column, extend radially outward from said center column and so that said panes are releasably detachable from said center column outside said center column.

2. The lighting fixture as in claim 1, wherein said panes are constructed at least partially from glass.

3. The lighting fixture as in claim 1, wherein each said pane includes a frame at least partially enclosing said pane.

4. The lighting fixture as in claim 1, wherein said panes are constructed at least partially from plastic.

5. The lighting fixture as in claim 1, wherein each said pane is of an elongated planar shape.

6. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes at least one pin extending from each said pane.

7. The lighting fixture as in claim 6, wherein at least one said pin from each said pane is received directly by said center column.

8. The lighting fixture as in claim 6, wherein said at least one pin is constructed integrally with its respective said pane.

9. The lighting fixture as in claim 6, wherein each said pane includes a frame extending at least partially about the edges thereof, and wherein said at least one pin is attached to said frame.

10. The lighting fixture as in claim 7, wherein said pin received directly by said center column includes a first section extending radially into said center column and an angular second section attached to the end of said first section opposite said center column.

11. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes an annular cap attached to said center column proximate a lower vertical end thereof and extending at least partially about said center column, said cap configured to receive each said pane.

12. The lighting fixture as in claim 11, wherein each said pane includes a vertical pin extending downward from said pane and wherein said annular cap is configured to receive said pins.

13. The lighting fixture as in claim 11, wherein said annular cap includes a plurality of upwardly extending pins and wherein each said pane is configured to receive a said pin to at least partially secure said pane to said center column.

14. The lighting fixture as in claim 11, wherein said annular cap includes a plurality of radial grooves, each said groove configured to receive a respective said pane.

15. The lighting fixture as in claim 11, wherein said annular cap includes a plurality of brackets, each said bracket configured to receive a respective said pane.

16. The lighting fixture as in claim 11, wherein said annular cap includes an annular rim extending above an upper surface thereof, said annular rim including a plurality of notches, each said notch configured to receive a respective said pane.

17. The lighting fixture as in claim 16, wherein said annular rim extends circumferentially about said annular cap.

18. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes an annular cap attached to said center column proximate an upper vertical end thereof and extending at least partially about said center column, said cap configured to receive each said pane.

19. The lighting fixture as in claim 18, wherein each said pane includes an upward vertical pin and said annular cap is configured to receive said pins.

20. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes a plurality of brackets attached to said center column and extending radially outward therefrom, each said bracket configured to receive a said pane.

21. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes at least one pin extending from each said pane and a plurality of brackets attached to said center column and extending radially outward therefrom, wherein said center column is configured to receive each said pin from a respective said pane to provide vertical support for said pane and wherein each said bracket is configured to receive a said pane to provide lateral support for said pane.

22. A lighting fixture, said lighting fixture comprising:

a vertical center column;

at least one light element operatively attached to said center column;

a plurality of vertical panes; and an attachment mechanism configured to removably attach said panes to said center column so that said panes, when attached to said center column, extend radially outward from said center column, wherein said attachment mechanism includes a plurality of longitudinal vertical grooves defined in said center column, each said groove configured to receive an edge of a respective said pane.

23. The lighting fixture as in claim 1, including at least one said light element disposed between each pair of adjacent said panes.

24. The lighting fixture as in claim 18, wherein said cap includes a ring for receipt of a mechanism for suspending said lighting fixture.

25. A lighting fixture, said lighting fixture comprising:

a vertical center column;

a plurality of vertical planar panes;

an annular bottom cap attached to said center column proximate a lower vertical end thereof and extending at least partially about said center column, said bottom cap configured to removably receive each said pane to at least partially vertically and horizontally secure said pane to said center column; and a plurality of light elements operatively connected to said center column and individually disposed between adjacent said panes.

26. The lighting fixture as in claim 25, including an upper attachment mechanism configured to at least partially horizontally secure said pane to said center column above said bottom cap.

27. The lighting fixture as in claim 25, wherein said bottom cap includes an annular rim extending above an upper surface thereof, said annular rim including a plurality of notches, each said notch configured to receive a respective said pane.

28. The lighting fixture as in claim 25, wherein said bottom cap includes a plurality of radial grooves, each said groove configured to receive a respective said pane.

29. The lighting fixture as in claim 25, wherein said bottom cap includes a plurality of brackets, each said bracket configured to receive a respective said pane.

30. The lighting fixture as in claim 25, wherein each said pane includes a vertical pin extending downward from said pane and wherein said bottom cap is configured to receive said pins.

31. The lighting fixture as in claim 26, wherein said upper attachment mechanism includes a plurality of longitudinal vertical grooves defined in said center column, each said groove configured to receive an edge of a respective said pane.

32. The lighting fixture as in claim 26, wherein said upper attachment mechanism includes a plurality of brackets attached to said center column and extending radially outward therefrom, each said bracket configured to receive a respective said pane.

33. The lighting fixture as in claim 26, wherein said upper attachment mechanism includes an annular upper cap attached to said center column proximate an upper vertical end thereof and extending at least partially about said center column, said cap configured to receive each said pane.

34. The lighting fixture as in claim 33, wherein each said pane includes an upward vertical pin and said upper cap is configured to receive said pins.

35. A lighting fixture, said lighting fixture comprising:

a vertical center column;

a plurality of vertical planar panes, each said pane including a first vertical pin extending downward from said pane and a second vertical pin extending upward from said pane;

an annular bottom cap attached to said center column proximate a lower vertical end thereof and extending at least partially about said center column;

an annular upper cap attached to said center column proximate an upper vertical end thereof and extending at least partially about said center column;

said bottom cap being configured to receive said first pins of said panes and said upper cap being configured to receive said second pins of said panes so that said panes are secured to said center column by said bottom cap and said upper cap; and a plurality of light elements operatively connected to said center column and individually disposed between adjacent said panes.

36. A lighting fixture, said lighting fixture comprising:

a vertical center column;

at least one light element operatively attached to said center column;

a plurality of vertical panes; and means for attaching said panes to said center column so that said panes, when attached to said center column, extend radially outward from said center column and are releasably detachable from said center column outside said center column.

* * * * *